US005687805A

United States Patent [19]

Perry

[11] Patent Number: 5,687,805

[45] Date of Patent: Nov. 18, 1997

[54] BACK REAMER APPARATUS

[76] Inventor: Robert G. Perry, 5335 East Terrace Ave., Indianapolis, Ind. 46203

[21] Appl. No.: 639,969

[22] Filed: Apr. 29, 1996

[51] Int. Cl.[6] ..... E21B 7/28

[52] U.S. Cl. ..... 175/53; 175/406

[58] Field of Search ..... 175/53, 406, 57, 175/62, 19, 100

[56] References Cited

U.S. PATENT DOCUMENTS

| | | | |
|---|---|---|---|
| 1,544,757 | 7/1925 | Hufford et al. | 175/406 |
| 2,664,273 | 12/1953 | Merrick | 175/53 |
| 3,874,463 | 4/1975 | Hicks et al. | 175/53 |
| 3,894,402 | 7/1975 | Cherrington | 175/53 X |
| 4,679,637 | 7/1987 | Cherrington et al. | 175/53 X |
| 5,220,964 | 6/1993 | Deken et al. . | |
| 5,301,758 | 4/1994 | Jenno | 175/53 X |
| 5,390,750 | 2/1995 | Deken et al. . | |
| 5,505,558 | 4/1996 | Brown | 175/53 X |

*Primary Examiner*—Frank Tsay
*Attorney, Agent, or Firm*—Barnes & Thornburg

[57] ABSTRACT

A back reamer apparatus is configured to be attached to a pipe section of a drilling rig for back reaming and compacting a pilot bore. The back reamer apparatus includes a body having a front end configured to be coupled to the pipe section, and at least three planar side walls configured to form a pyramid-shaped section which is tapered downwardly toward the front end of the body to compact the soil and form an enlarged bore upon rotation of the body by the drilling rig. The body is formed to include an internal passageway for receiving a drilling fluid. Each of the side walls is formed to include at least one aperture in communication with the passageway to permit the drilling fluid to pass through the at least one aperture formed in each side wall.

20 Claims, 3 Drawing Sheets

BACK REAMER APPARATUS

BACKGROUND AND SUMMARY OF THE INVENTION

The present invention relates to an improved back reamer apparatus for expanding a pilot bore formed by a horizontal drilling rig.

It is well known to push a rod or pipe through the ground with a drilling rig from one location to another predetermined location beneath the surface of the ground. For example, a pipe may be pushed under a road from one side of the road to another without creating a trench in the road. Generally speaking, apparatus for directing forward movement of a pipe through the ground beneath the surface of the ground are known in the art. Typically, drilling rigs rotate the pipe in a counterclockwise direction or a clockwise direction to install or remove pipe from the ground.

After a pilot bore has been completed by the drilling rig, it is known to couple a back reamer to the pipe and to move the pipe and the attached back reamer in a direction opposite to the direction that the pilot bore was drilled. Back reamers expand the pilot bore to a desired final diameter. Conventional back reamers include cutters or teeth for cutting or agitating the soil. However, these known cutters and teeth can break. The cutters and teeth also provide increased drag for the back reamer.

The present invention provides an improved back reamer for use in compactible soil such as clay, sand, etc. with a horizontal drilling rig. The back reamer of the present invention has a pyramid-shaped body section for improved compacting the soil. Tapered side walls of the back reamer move the soil radially outwardly from an axis of rotation and compact the soil during rotation of the back reamer by the drilling rig. Drilling fluid jets are provided in the back reamer to soften and compact the soil. The drilling fluid is transferred through the back reamer to fill the bore or hole created by the back reamer and hold it open. The improved shape of the back reamer of the present invention permits rotation of the back reamer with substantially less torque than conventional back reamers. The pyramid-shaped back reamer of the present invention has fewer square inches in contact with the ground at any one time. Therefore, less torque is required to rotate the back reamer.

According to one aspect of the present invention, a back reamer apparatus is configured to be attached to a pipe section of a drilling rig for back reaming and compacting a pilot bore. The back reamer apparatus includes a body having a front end configured to be coupled to the pipe section, and a pyramid-shaped section having side walls which are tapered downwardly toward the front end of the body to compact the soil and form an enlarged bore upon rotation of the body by the drilling rig.

The pyramid-shaped section includes at least three planar side walls. In the illustrated embodiment, the pyramid-shaped section is a right rectangular pyramid.

The body is formed to include an internal passageway for receiving a drilling fluid. Each of the side walls is formed to include at least one aperture in communication with the passageway to permit the drilling fluid to pass through the at least one aperture formed in each side wall. The at least one aperture formed in each of the side walls is spaced apart from a leading edge of the side wall to reduce clogging of the at least one aperture.

In the illustrated embodiment, each of the side walls is formed to include a wear resistant hardened surface adjacent a leading edge. The hardened surface is formed by at least one welded strip of material located adjacent the leading edge of each side wall. The wear resistant hardened surface extends downwardly about one inch from each leading edge. Preferably, the hardened surface has a hardness of at least 60 Rockwell.

In one illustrated embodiment, the apparatus includes a round plate coupled to a rear end of the body. The plate is formed to include a plurality of apertures to permit drilling fluid to pass through the apertures in the plate and enter the enlarged bore formed by the pyramid-shaped section of the body. A coupler is rotatably coupled to the plate.

Also in the illustrated embodiment, the body has a longitudinal axis, and each of the side walls is aligned at an angle of about 40° relative to the longitudinal axis. The side walls are aligned at an angle of about 50° relative to the plate. Preferably, each of the side walls is aligned at an angle of 39° relative to the longitudinal axis, and each of the side walls is aligned at an angle of 51° relative to the plate.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
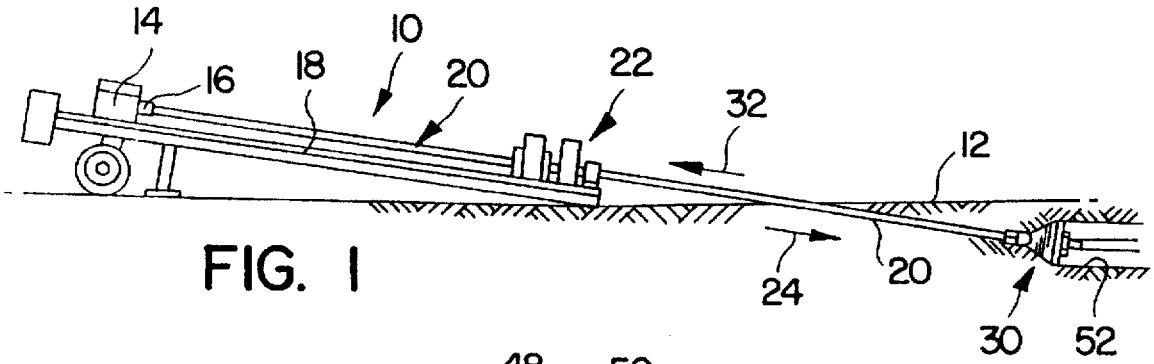
FIG. 1 is a diagrammatical illustration of a horizontal drilling rig with a back reamer of the present invention attached to the pipe sections for enlarging a pilot bore formed in the ground.

Referring now to the drawings, FIG. 1 illustrates a horizontal drilling rig 10 for drilling a trenchless bore under the ground 12 for utility lines or other services. The horizontal drilling rig 10 eliminates the need for digging a trench along the entire length of the bore. Therefore, the bore can be formed under existing structures without damaging or interfering with those structures.

The drilling rig 10 includes a main drive unit 14 having a threaded drive head 16. The main drive unit 14 is driven back and forth over a frame 18. Main drive unit 14 rotates the threaded drive head 12 to drive pipe sections 20 into the ground in a conventional manner. A tong apparatus 22 is provided for making and breaking joint connections between adjacent pipe sections 20. Main drive unit 14 drills a pilot bore through the ground 12 by advancing the pipe sections 20 in the direction of arrow 24. After the pilot bore is formed, a back reamer 35 apparatus 30 is coupled to the leading pipe 20. The pipe sections 20 are then rotated and pulled back in the direction of arrow 32 so that the back reamer 30 enlarges the pilot bore. The back reamer 30 compacts and stabilizes the soil to form the wall of the bore 52 as the drilling rig 10 rotates and pulls the back reamer 30 in the direction of arrow 32.

Figure 3:
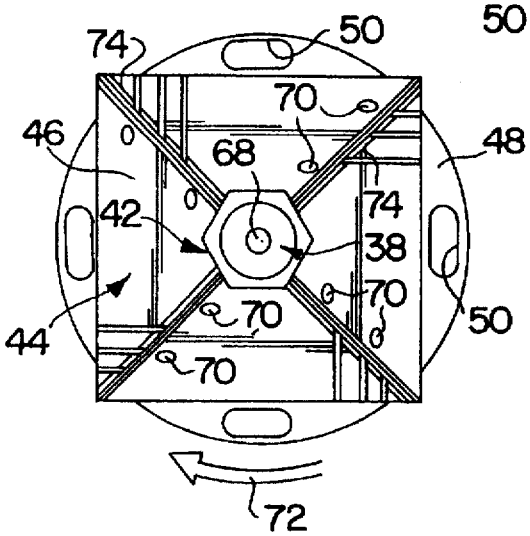
FIG. 3 is a front view of the back reamer apparatus of FIG. 2.
Figure 4:
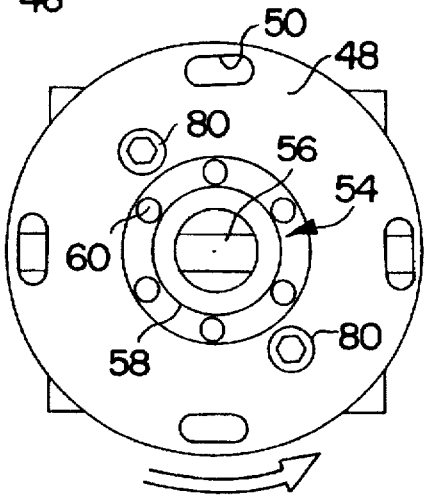
FIG. 4 is a rear view of the back reamer apparatus of FIG. 2.
Figure 5:
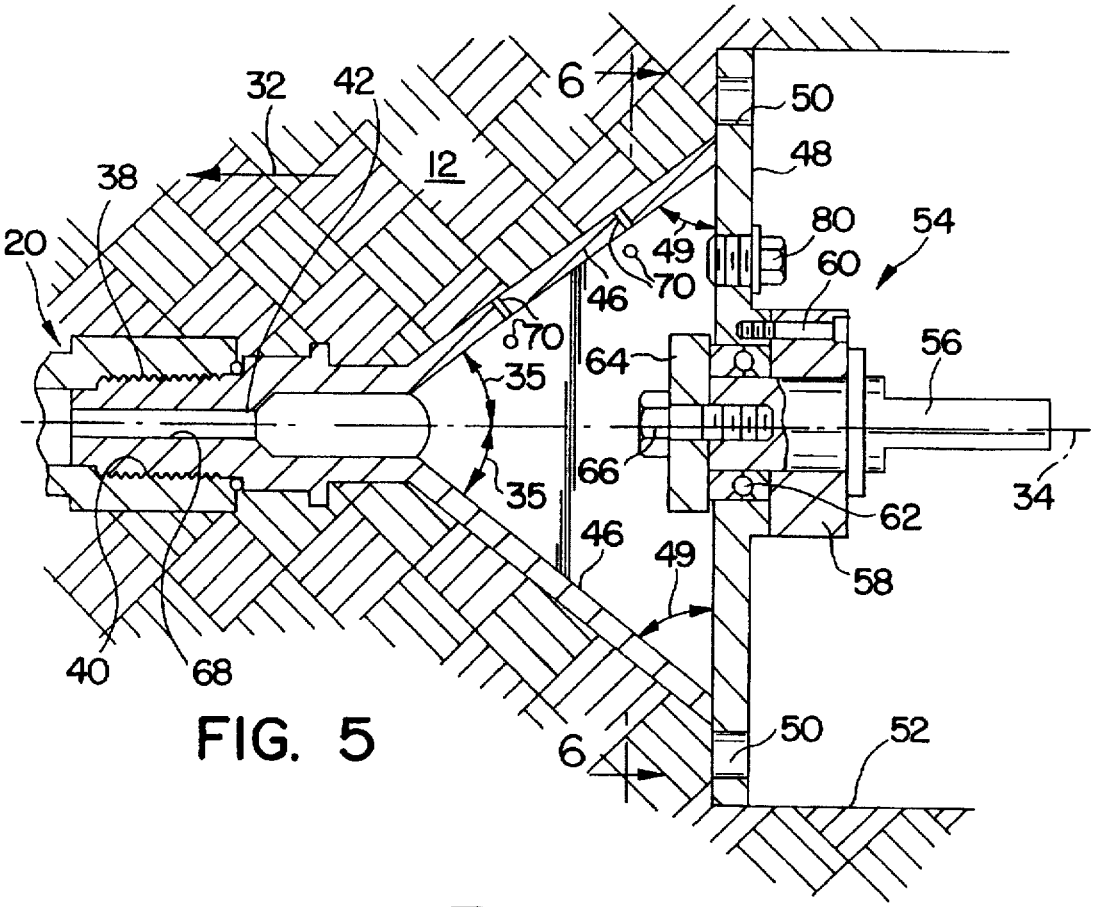
FIG. 5 is a sectional view taken through the back reamer apparatus of FIGS. 2–4 as the back reamer apparatus is pulled through the ground by the drilling rig to expand the pilot bore initially created by the drilling rig.

A first embodiment of the back reamer 30 of the present invention is best illustrated in FIGS. 2–6. The back reamer 30 has a longitudinal axis 34. Back reamer 30 includes a front cylindrical section 36 having a male threaded end 38 configured to be attached to a female threaded section 40 of the leading pipe 20 after the pilot bore has been drilled as best illustrated in FIG. 5. A hexagonal section 42 is located adjacent the male threaded section 38 to facilitate attachment and removal of the back reamer 30 from the leading pipe section 20.

The improved back reamer 30 includes a pyramid-shaped body section 44. In the illustrated embodiment, the pyramid-shaped body section is a right rectangular pyramid having four planar side walls 46 which converge toward the front cylindrical section 36 to form the pyramid-shaped body portion 44. It is understood that any pyramid-shaped body portion having at least three planar side walls 46 may be used in accordance with the present invention. In addition, a pyramid-shaped body portion having more than four side walls can also be used.

In the first embodiment of the present invention illustrated in FIGS. 2–6, a round plate 48 having apertures 50 is coupled to body portion 44. The plate 48 is configured to help form the enlarged bore 52 illustrated in FIGS. 1 and 5. A swivel attachment 54 is coupled to plate 48. Swivel attachment 54 includes a rotatable coupler 56 that is held in place by a mounting 58. Mounting 58 is secured to plate 48 by suitable fasteners 60. A bearing 62 permits rotation of the coupler 56 relative to the plate 48. The coupler 56 and bearing 62 are further held in place by a support 62 located within the body 44 of the back reamer 30 and by a suitable fastener 66.

Figure 2:
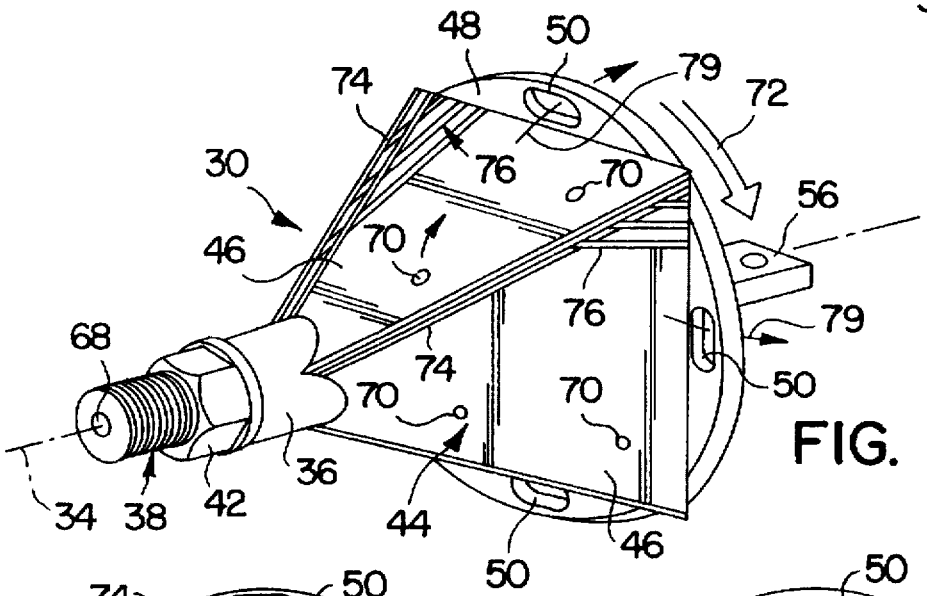
FIG. 2 is a perspective view of the pyramid-shaped back reamer apparatus of the present invention.

As best illustrated in FIGS. 2 and 5, back reamer 30 is formed to include an internal passageway 68. The passageway 68 is formed through the back reamer 30 concentric with the longitudinal axis 34. A drilling fluid is supplied to passageway 68 through the series of pipe sections 20 in a conventional manner. The drilling fluid enters the body portion 44 of the back reamer 30 and is discharged through a plurality fluid outlet apertures 70 formed in side walls 46 as discussed below.

FIG. 5 also illustrates the preferred angles for side walls 46 of the pyramid-shaped body section 44. Side walls 46 are aligned at an angle of about 39° relative to the longitudinal axis 34 as illustrated by angle 35. Side walls 46 are aligned at an angle of about 51° relative to plate 48 as illustrated by angles 49.

In operation, after the pilot hole is drilled by drilling rig 10, the back reamer 30 is coupled to the female threaded section 40 of the leading pipe 20. Drilling rig 10 is then controlled to rotate and pull the back reamer 30 in the direction of arrow 32 of FIGS. 1 and 5 to form the enlarged bore 52. Main drive unit 14 rotates the plurality of pipe sections 20 and the drilling rig 30 in the direction of arrow 72. Rotation of the back reamer 30 causes the pyramid-shaped body section 44 to compact the soil surrounding the pilot bore and form the enlarged bore 52.

Figure 6:
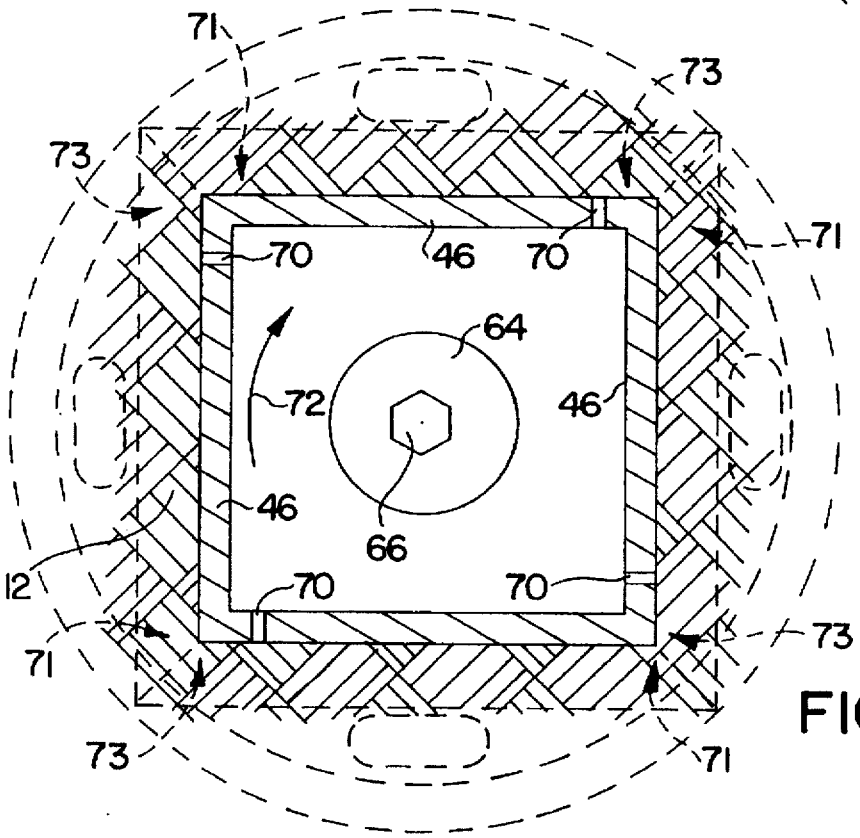
FIG. 6 is a sectional view taken along lines 6—6 of FIG. 5.

Rotation of the back reamer 30 in the direction of arrow 32 causes top or leading edges 71 of the side walls 46 to engage and compact the soil 12 as best illustrated in FIG. 6. FIG. 6 also illustrates that the drilling fluid apertures 70 are formed in bottom or trailing edges 73 next to a leading edge 71 of an adjacent side wall 46. Such position of the apertures 70 reduces clogging of the apertures 70 with soil during rotation of the back reamer 30 in the direction of arrow 72.

The back reamer 30 includes a hard, wear resistant oversurface 74 located adjacent each top or leading edge 71 of side walls 46 as best illustrated in FIGS. 2–4. Preferably, the hard oversurface 74 is a welded carbide material having a hardness of at least 60 Rockwell. Preferably, the hard oversurface extends a width of about one inch from a top edge of each of the planar side walls 46 of the pyramid-shaped body portion 44. Additional wear resistant oversurface material 76 may be provided on side walls 46, if necessary.

The welded oversurface material 74 can be quickly replaced or built up by welding areas 74 and 76 after use of the back reamer 30, if necessary due to wear. Therefore, the back reamer 30 is able to reused quickly. It is not necessary to wait for replacement parts or make complicated repairs to the back reamer 30.

The improved pyramid-shaped body section 44 of the present invention is tapered to provide less surface area for drag as the back reamer 30 is rotated and pulled through the ground 12 in the direction of arrow 32. Because of the improved pyramid-shaped body section 44, the back reamer 30 can be rotated with substantially less torque than conventional back reamers.

As discussed above, drilling fluid is injected through the pipes 20 and into the passageway 68 of back reamer 30. Drilling fluid is ejected through outlet apertures 70 which provide fluid jets to soften and compact the soil surrounding the back reamer 30. Drilling fluid is then transferred through the apertures 50 formed in plate 48 as illustrated by arrows 79 of FIG. 2 to fill the enlarged bore 52. The drilling fluid holds the enlarged bore 52 open as the back reamer 30 moves in the direction of arrow 32. The improved tapered side walls 46 of the pyramid-shaped body section 44 move the soil radially outwardly away from the longitudinal axis 34 of the back reamer 30 to compact the soil and form the bore 52 as the back reamer 30 rotates in the direction of arrow 72.

The improved back reamer 30 of the present invention uses compaction of the soil to form the enlarged bore 52. Therefore, the improved back reamer 30 of the present invention is designed for use with compactible soil such as clay, sand, etc. The back reamer 30 of the present invention does not cut or agitate the soil as performed by conventional back reamers. The improved pyramid-shaped body section 44 which compacts the soil advantageously provides fewer square inches in contact with the ground at any one time as compared to conventional back reamers having cutters or agitators. Therefore, less torque is required to rotate the back reamer 30 than conventional back reamers. After the enlarged bore 52 is formed, plugs 80 can be removed from plate 48 to permit cleaning of the interior region of the back reamer 30.

Figure 7:
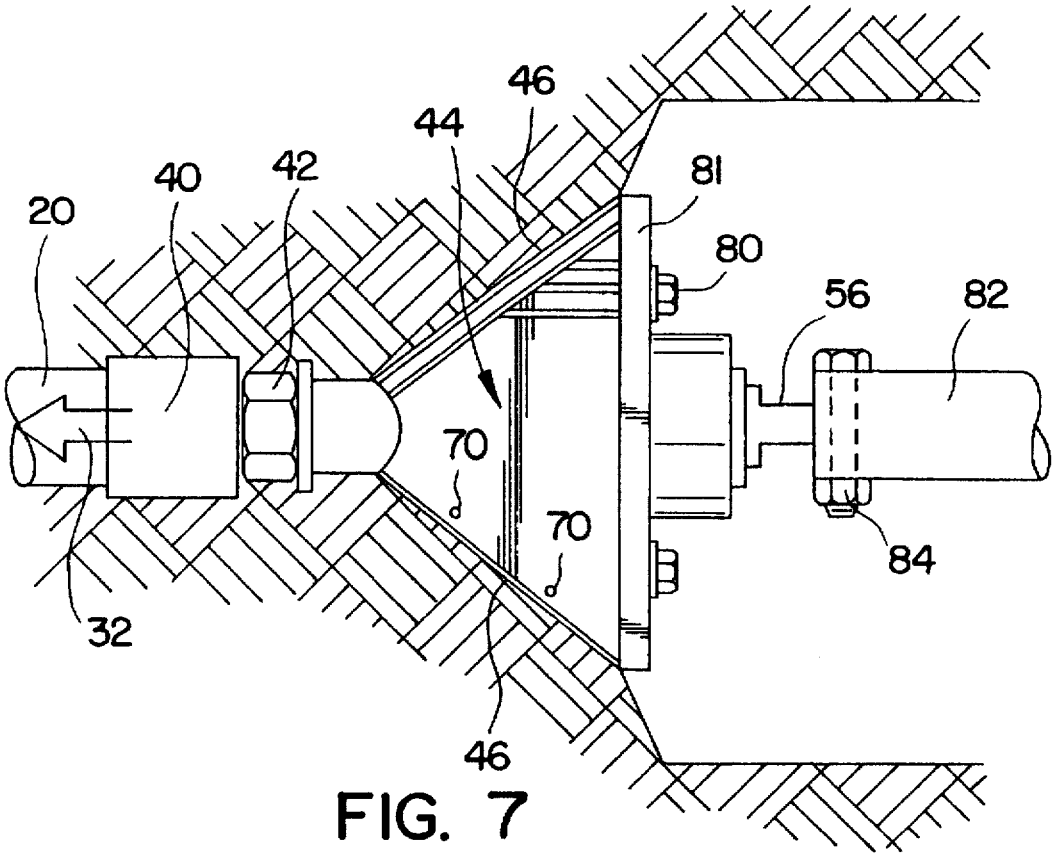
FIG. 7 is a sectional view similar to FIG. 5, illustrating another embodiment of the back reamer apparatus of the present invention.
Figure 8:
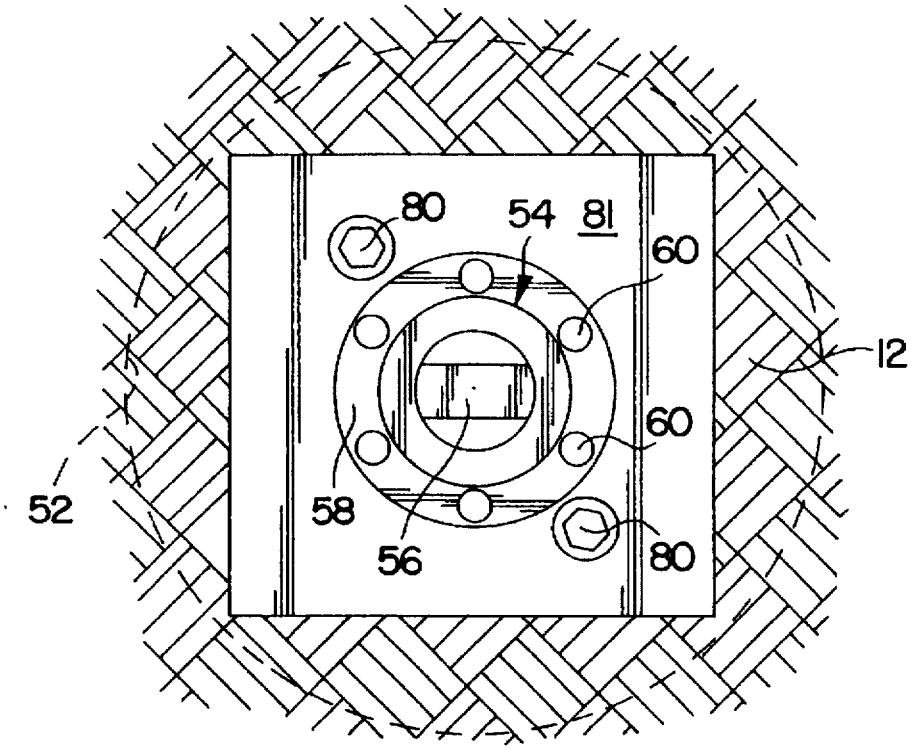
FIG. 8 is a rear view of the back reamer apparatus of FIG. 7.

Another embodiment of the present invention is illustrated in FIGS. 7 and 8. In this embodiment, a square plate 81 is attached to the pyramid-shaped body portion 44 in place of the round plate 48. The remaining elements are the same as the embodiment of FIGS. 1–6. FIG. 7 illustrates that a pipe 82 or other equipment can be connected to the coupler 56 with a suitable fastener 84 to pull the pipe 82 along with the back reamer 30 in the direction of arrow 32.

Although the invention has been described in detail with reference to a certain preferred embodiment, variations and modifications exist within the scope and spirit of the present invention as described and defined in the following claims.

What is claimed is:

1. A back reamer apparatus configured to be attached to a pipe section of a drilling rig for back reaming and compacting a pilot bore, the back reamer apparatus comprising a body having a front end configured to be coupled to the pipe section, and at least three planar side walls configured to form a pyramid-shaped section which is tapered downwardly toward the front end of the body to compact the soil and form an enlarged bore upon rotation of the body by the drilling rig, the body being formed to include an internal passageway for receiving a drilling fluid, each of the side walls being formed to include at least one aperture in communication with the passageway to permit the drilling fluid to pass through the at least one aperture formed in each side wall.

2. The apparatus of claim 1, wherein each of the side walls is formed to include a wear resistant hardened surface adjacent a leading edge.

3. The apparatus of claim 2, wherein the hardened surface is formed by at least one welded strip of material located adjacent the leading edge of each side wall.

4. The apparatus of claim 2, wherein the wear resistant hardened surface extends downwardly about one inch from each leading edge.

5. The apparatus of claim 2, wherein the hardened surface has a hardness of at least 60 Rockwell.

6. The apparatus of claim 1, further comprising a round plate coupled to a rear end of the body, the plate being formed to include a plurality of apertures to permit drilling fluid to pass through the apertures in the plate and enter the enlarged bore formed by the pyramid-shaped section of the body.

7. The apparatus of claim 6, further comprising a coupler rotatably coupled to the plate.

8. The apparatus of claim 1, wherein the body has a longitudinal axis, each of the side walls being aligned at an angle of about 40° relative to the longitudinal axis.

9. The apparatus of claim 8, wherein each of the side walls is aligned at an angle of 39° relative to the longitudinal axis.

10. The apparatus of claim 1, further comprising a plate coupled to a rear end of the body, each of the side walls being aligned at an angle of about 50° relative to the plate.

11. The apparatus of claim 10, wherein each of the side walls is aligned at an angle of 51° relative to the plate.

12. The apparatus of claim 1, wherein the front end of the body is a male threaded member.

13. The apparatus of claim 1, further comprising a hexagonal portion located adjacent the front end of the body to facilitate coupling of the body to the pipe section.

14. The apparatus of claim 1, wherein the at least one aperture formed in each of the side walls is spaced apart from a leading edge of the side wall to reduce clogging of the at least one aperture.

15. The apparatus of claim 1, wherein the pyramid-shaped section is a right rectangular pyramid.

16. A back reamer apparatus configured to be attached to a pipe section of a drilling rig for back reaming and compacting a pilot bore, the back reamer apparatus comprising a body having a front end configured to be coupled to the pipe section, and a pyramid-shaped section having side walls which are tapered downwardly toward the front end of the body to compact the soil and form an enlarged bore upon rotation of the body by the drilling rig.

17. The apparatus of claim 16, wherein the body is formed to include an internal passageway for receiving a drilling fluid, each of the side walls being formed to include at least one aperture in communication with the passageway to permit the drilling fluid to pass through the at least one aperture formed in each side wall.

18. The apparatus of claim 16, wherein each of the side walls is formed to include a wear resistant hardened surface adjacent a leading edge.

19. The apparatus of claim 18, wherein the hardened surface is formed by at least one welded strip of material.

20. The apparatus of claim 16, wherein the pyramid-shaped section is a right rectangular pyramid.

* * * * *